United States Patent [19]

Kizawa

[11] Patent Number: 4,677,953

[45] Date of Patent: Jul. 7, 1987

[54] FUEL INJECTION SYSTEM FOR INTERNAL-COMBUSTION ENGINES

[75] Inventor: Horofumi Kizawa, Oyama, Japan

[73] Assignee: Kabushiki Kaisha Komatsu Seisakusho, Tokyo, Japan

[21] Appl. No.: 664,719

[22] Filed: Oct. 25, 1984

[30] Foreign Application Priority Data

Oct. 26, 1983 [JP] Japan ..... 58-164623[U]
Oct. 31, 1983 [JP] Japan ..... 58-167627[U]

[51] Int. Cl.[4] ..... F02M 41/06

[52] U.S. Cl. ..... 123/450; 123/446; 417/462

[58] Field of Search ..... 123/450, 446, 459, 467; 417/462, 299

[56] References Cited

U.S. PATENT DOCUMENTS 1,776,861 7/1930 Rathbum ..... 123/450
2,385,089 9/1945 Lerner ..... 123/450
4,200,074 4/1980 Kosuda et al. ..... 123/450
4,387,686 6/1983 Leblanc et al. ..... 123/446
4,407,250 10/1983 Eheim et al. ..... 123/450
4,440,134 4/1984 Nakao et al. ..... 123/447
4,465,049 8/1984 Eckert et al. ..... 123/446

*Primary Examiner*—Willis R. Wolfe, Jr.
*Attorney, Agent, or Firm*—Armstrong, Nikaido, Marmelstein & Kubovcik

[57] ABSTRACT

A fuel injection system for internal combustion engines has a rotary valve device driven in synchronism with a cam shaft of the engine to distribute high-pressure fuel to unit injectors of the engine. The rotary valve device comprises a rotary spool having fuel supply port and a plurality of fuel metering grooves formed on the circumference of the spool. The fuel metering grooves are respectively provided with check valves. The rotary spool further comprises a pressure relief port for draining part of fuel accumulated in each of the unit injectors and a fuel supply pipe connected between the rotary valve device and the unit injector. The pressure relief port is formed on the circumference of the spool and between the fuel supply port and the fuel metering grooves.

6 Claims, 5 Drawing Figures

FUEL INJECTION SYSTEM FOR INTERNAL-COMBUSTION ENGINES

BACKGROUND OF THE INVENTION

The present invention relates to a fuel injection system for a diesel engine, and more particularly to a rotary valve device for distributing fuel to intensifying unit injectors.

U.S. Pat. No. 4,440,134 granted to Kiyoharu Nakao discloses a known conventional fuel injection system employing a rotary valve device. According to FIG. 1 given in the specification of the same U.S. patent, a high-pressure fuel supply pump 10 is driven by the internal combustion engine 12 to supply fuel from a fuel tank 14 at a high pressure. The pressure of the high-pressure fuel discharged by the high-pressure pump 10 changes pulsatively over a wide range. Accordingly, the fuel discharged by the high-pressure pump 10 is accumulated temporarily in an accumulator 16, and then supplied to the rotary valve 18 after reducing the pressure variation. The rotary valve 18 is driven in synchronism with the cam shaft of the engine 12 to distribute the high-pressure fuel to the injectors $\mathbf{20}_1$, $\mathbf{20}_2$ . . . and $\mathbf{20}_6$. As shown in FIG. 3 of the same U.S. Patent specification, the rotary valve 18 has a cylindrical rotary sleeve 24 fitted for rotary motion through a predetermined angle in a housing 22 HS and a rotary shaft 26 fitted rotatably and concentrically in the rotary sleeve RL. Ports $P_1$, $P_2$ and $P_3$ and ports $Q_1$, $Q_2$ and $Q_3$ are formed correspondingly at predetermined positions in the housing 22 and the rotary sleeve RL 24 respectively. Circumferential recesses 28 and 30 are formed at predetermined positions on the circumference of the rotary shaft 26 to change over between an injecting range and a metering range (a range to decide the amount of fuel to be injected). The rotary shaft 26 is driven for rotation in synchronism with the cam shaft, not shown, of the engine 12, for example, in a clockwise direction.

In the conventional rotary valve device, only a single metering groove (a groove to decide the amount of fuel to be injected) is formed in the rotary shaft which also is designated as a rotary spool. Therefore, four to six unit injectors interfere with each other in metering the fuel, and hence the disturbance occurred in one of the unit injectors affects the rest of the unit injectors to disturb the stability of fuel metering.

The fuel metering process in the prior art intensifying unit injectors will be described hereunder in connection with FIG. 1.

At the completion of fuel injection by a unit injector 10*a*, the piston 12 and the plunger 13 of the unit injector 10*a* are moved to and positioned at the respective bottom positions and a fuel supply pipe 15*a* and the upper pressure chamber 14 of the unit injector 10*a* are filled with the high-pressure fuel.

A fuel supply port 25 is formed at a position on the circumference of the rotary spool 22 of a rotary valve 20. One end of the fuel supply port 25 communicates with a fuel passage 24 which communicates with a fuel supply pipe 27. The other end of the fuel supply port 25 faces a conduit 15*d* at the time of fuel injection from a unit injector 10*d* to depress the piston 12 and the plunger 13 against the resilient force of the metering spring 11. A metering groove 30 is formed at another position on the circumference of the rotary spool 22 to connect the upper pressure chamber 14 of the unit injector 10*a* through a conduit 15*a* to a drain pipe 28 after the completion of fuel injection from the unit injector 10*a*.

When the conduit 15*a* communicates with the drain pipe 28 by means of the metering groove 30 of the rotary spool 22 after the completion of the fuel injection, the fuel remaining in the upper pressure chamber 14 of the unit injector 10*a* is pushed out by the resilient force of the metering spring 11 and is drained through a metering valve 29 provided in the drain pipe 28. The amount of fuel to be injected is dependent on the upward return travel of the plunger 13. Accordingly, if the opening of the metering valve 29 is small, the return travel of the piston 12 and the plunger 13 is limited to a small extent by an increased flow resistance, and thereby the amount of fuel injection is reduced. On the contrary, if the opening of the metering valve is large, the flow resistance decreases, and thereby the piston 12 and the plunger 13 are allowed to make an increased return travel, and hence the amount of fuel injection is increased.

Basically, the amount of fuel injection is controlled according to the above-mentioned conception. In a practical internal combustion engine, the amount of fuel injection is controlled by regulating the opening of the metering valve 29 through the feedback of the output of the engine. Accordingly, the relation between the amount of fuel injection and the opening of the metering valve needs to be monotonic.

Nevertheless, if the opening of the metering valve is fixed, generally the amount of fuel injection decreases when the engine speed increases, which causes the engine speed to decrease again, whereas if the engine speed decreases the amount of fuel injection increases, which causes the engine speed to increase again. That is, the relationship between the amount of fuel injection and the engine speed becomes a negative slope so that the engine speed is stabilized. However, within a certain range of engine speed, such a relationship becomes a positive slope, and hence the engine speed becomes unstable. Accordingly, the control of the amount of fuel injection is generally complicated.

The reason why the relationship between the amount of fuel injection and the engine speed becomes a positive slope is due to a fact that the amount of fuel drain through the metering valve 29 does not varies monotorously with respect to the engine speed, because there is unevenness between respective amounts of fuel reserved within the upper pressure chambers 14 of unit injections 10*a* . . . and 10*f* and within fuel supply pipes 15*a* . . . and 15*f* owing to the unsteady state of the fuel within the upper pressure chambers 14 of the unit injectors 10*a* . . . and 10*f* and within the fuel supply pipes 15*a* . . . and 15*f*.

SUMMARY OF THE INVENTION

Accordingly, it is an object of the present invention to provide a fuel injection system for internal combustion engines, capable of eliminating the mutual interference of the unit injectors with injection fuel metering and securing steady injection fuel metering.

Another object of the present invention is to provide a fuel injection system for internal combustion engines, capable of stabilizing the amount and the pressure of the fuel accumulated in the cunduits and pipes connecting a rotary valve device and the unit injectors and within the upper pressure chambers of the unit injectors so that the amount of fuel to be drained through a metering valve after completion of fuel injection varies smoothly without causing unevenness with respect to the increase of the engine spped so as to reduce monotonously the amount of fuel to be injected.

Still another object of the present invention is to provide a fuel injection system for internal combustion engines which, in case a fuel supply pipe connecting one of the unit injectors to the rotary valve device is broken, is capable of preventing the flow of metered fuel from the other unit injectors into the broken fuel supply pipe to eliminate the uncontrolled runaway operation of the engine due to the increase of the amount of fuel injection resulting from fuel leakage through the broken fuel supply pipe entailing the drop of the metering pressure.

According to a first aspect of the present invention, in order to attain the above described objects of the invention, there is provided a fuel injection system for internal combustion engines, equipped with a rotary valve device which is driven in synchronism with the cam shaft of the engine to distribute the high-pressure fuel to the unit injectors, comprising a rotary spool having fuel supply port means and metering groove means for metering the amount of fuel injection each formed on the circumference thereof, characterized in that the metering groove means is formed of a plurality of independent divisions.

According to a second aspect of the present invention, there is provided a fuel injection system for internal combustion engines, equipped with a rotary valve device which is driven in synchronism with a cam shaft of the engine to distribute the high pressure fuel to unit injectors, comprising a rotary spool having fuel supply port means and metering groove means for metering the amount of fuel injection each formed on the circumference thereof, characterized in that pressure relief port means to drain part of the fuel accumulated in the conduits connecting the unit injectors to the rotary valve device and in the upper pressure chambers of the unit injectors before the metering process is provided at an intermediate position between the fuel supply port means and the metering groove means.

According to a third aspect of the present invention, the metering groove means of the fuel injection system for internal combustion engines is provided with check valves.

BRIEF DESCRIPTION OF THE DRAWINGS

The above and many other advantages, features and additional objects of the present invention will become manifest to those versed in the art upon making reference to the following detailed description and the accompanying drawings in which preferred structural embodiments incorporating the principles of the present invention are shown by way of illustrative example.

DETAILED DESCRIPTION OF THE PREFERRED EMBODIMENTS

Figure 3:
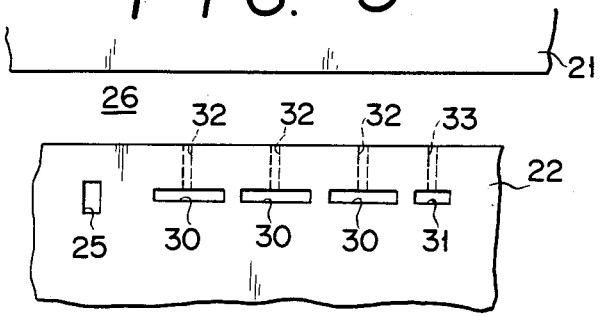
FIG. 3 is a development of the rotary spool of a rotary valve unit employed in a first embodiment of the present invention.
Figure 4:
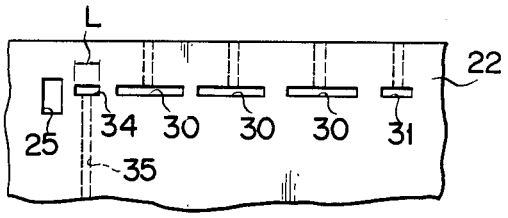
FIG. 4 is a development of the rotary spool of another rotary valve employed in a second embodiment of the present invention.
Figure 5:
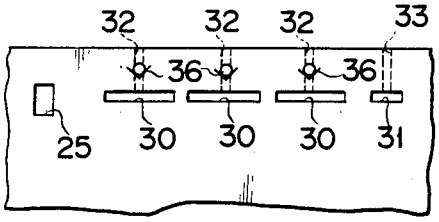
FIG. 5 is a development of the rotary spool of still another rotary valve employed in a third embodiment of the present invention.

Further details of the present invention will be described hereinafter in connection with FIGS. 3 to 5 showing developments of the circumferential surfaces of rotary spools.

Referring first to FIG. 3 showing a first embodiment of the present invention, a plurality of divisonal metering grooves 30 and a drain groove 31 are formed separately in the circumferenial surface of a rotary spool 22. Each metering groove 30 communicates with a metering pressure chamber 26 formed between one end surface of the spool 22 and a rotary valve body 21 by means of a connecting hole 32. The drain groove 31 communicates with the metering pressure chamber 26 by means of a connecting hole 33.

Figure 1:
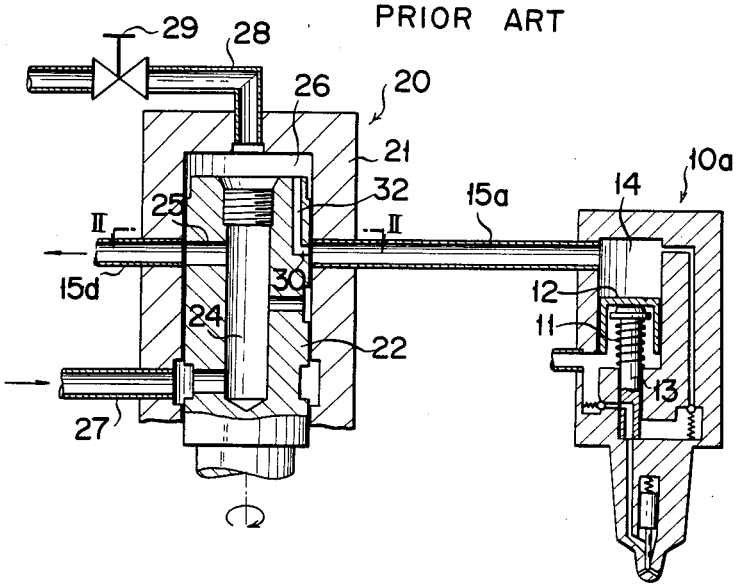
FIG. 1 PRIOR ART
FIG. 1 is a fragmentary schematic sectional view showing prime parts of a conventional fuel injection system for internal-combustion engines.
Figure 2:
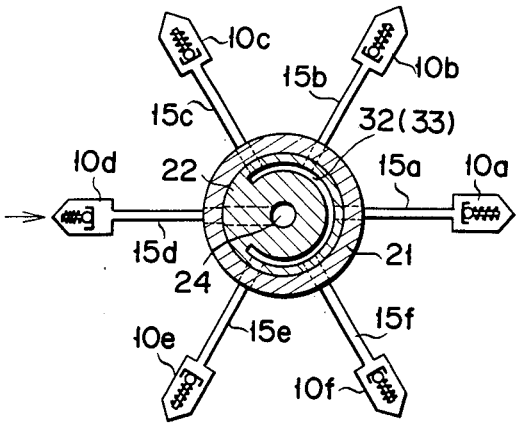
FIG. 2 PRIOR ART
FIG. 2 is a sectional view taken along line II—II of FIG. 1.

The metering grooves 30 and the drain groove 31 coincide sequentially with a plurality of ports opening in the inner circumference of the rotary valve body 21 and communicating with a plurality of conduits connecting unit injectors to the rotary valve unit (refer to FIG. 1) respectively as the rotary spool 22 rotates.

According to the present invention, the metering grooves 30 are formed separately from each other and so that the fuel returned from each unit injector during fuel metering process after the completion of fuel injection will not be distributed to the metering grooves 30. Accordingly, even if the unit injectors interfere with each other by any chance, the interference occurs through the metering pressure chamber 26 of a large capacity. Therefore, the disturbance of any unit injector will never affects other unit injectors.

FIG. 4 shows a second embodiment of the present invention. Referring to FIG. 4, a pressure relief port 34 is formed in a rotary spool 22 between a fuel supply port 25 and metering grooves 30. The pressure relief port 34 is connected to a fuel draining hole 35 drilled in the rotary spool 22. Before the start of a injection fuel metering process during the rotation of the rotary spool 22, part of the fuel remaining in the conduit and the upper pressure chamber of the unit injector is allowed to flow through the pressure relief port 34 into the fuel draining hole 35. Consequently, the fuel accumulated in the conduit and the upper pressure chamber of the unit injector flows into the metering groove at a reduced and stable pressure and is drained through the connecting hole 32, the metering chamber 26, the drain pipe (the pipe indicated at 28 in FIG. 1) and the metering valve (a valve indicated at 29 in FIG. 1). Accordingly, the amount of fuel drained through the metering valve varies monotonously without causing unevenness with respect to the engine speed.

A fixed amount of the fuel needs to be accumulated in the conduit and the upper pressure chamber of the unit injector in order to adjust the unit injector which injects a reduced amount of the fuel. The length L of the pressure relief port 34 along the direction of rotation of the rotary spool 22 is decided suitably to adjust the opening duration of the pressure relief port 34 so that an optimum amount of the fuel is accumulated in the upper pressure chambers of the unit injectors and the conduits.

Referring now to FIG. 5 showing a third embodiment of the present invention, check valves 36 are provided in connecting holes 32 connecting metering grooves 30 to a metering pressure chamber 26 respectively. Each check valve 36 permits the flow of the fuel only from the metering groove 30 toward the metering pressure chamber 26. Thus even if one of the conduits for the unit injectors is broken, the flow of the fuel from the other unit injectors and other conduits into the metering pressure chamber 26 is checked by the corresponding check valves to prevent the leakage of the fuel returned from the other unit injectors and the other conduits through the broken conduit. Accordingly, the uncontrolled runaway operation of the engine due to the injection of an increased amount of the fuel resulting from the drop of the metering pressure caused by fuel leakage is prevented.

I claim:

1. A fuel injection system for internal combustion engines, comprising a rotary valve device which is driven in synchronism with a came shaft of the engine to distribute high pressure fuel to unit injectors of the engine and has a rotary spool rotating in a housing having fuel supply port means and fuel metering groove means in said housing and disposed in a plane perpendicular to the axis of said spool for metering the amount of fuel injection each formed on the circumference thereof, characterized in that said fuel metering groove means includes a plurality of independent divisions, one for each unit injector.

2. A fuel injection system according to claim 1, wherein each of the independent divisions is provided with a check valve.

3. A fuel injection system for internal combustion engines, comprising a rotary valve device which is driven in synchronism with a cam shaft of the engine to distribute high pressure fuel to unit injectors of the engine and has an upper pressure chamber and a rotary spool having fuel supply port means and fuel metering groove means for metering the amount of fuel injection including a plurality of separate and independent groove means each formed on the circumference thereof, wherein pressure relief port means for draining part of the fuel accumulated in a conduit connecting each unit injector to the rotary valve device and in the upper pressure chamber of the corresponding unit injector before the start of the fuel metering process is formed between said fuel supply port means and said fuel metering groove means.

4. A fuel injection system according to claim 3, wherein said pressure relief port means communicates with a fuel drain hole drilled in the rotary spool.

5. A fuel injection system according to claim 4, wherein said fuel metering groove means includes a plurality of independent divisions.

6. A fuel injection system according to claim 5, wherein the independent divisions of said fuel metering groove means are provided with check valves respectively.

* * * * *